US006181292B1

(12) United States Patent
Dobrovolny

(10) Patent No.: US 6,181,292 B1
(45) Date of Patent: Jan. 30, 2001

(54) COMBINED UHF AND VHF ANTENNA

(75) Inventor: Pierre Dobrovolny, North Riverside, IL (US)

(73) Assignee: Zenith Electronics Corporation, Glenview, IL (US)

( * ) Notice: Under 35 U.S.C. 154(b), the term of this patent shall be extended for 0 days.

(21) Appl. No.: 09/469,422

(22) Filed: Dec. 23, 1999

(51) Int. Cl.[7] ..... H01Q 19/30
(52) U.S. Cl. ..... 343/819; 343/809; 343/818
(58) Field of Search ..... 343/805, 806, 343/808, 809, 811, 815, 817, 819, 818; H01Q 19/30

(56) References Cited

U.S. PATENT DOCUMENTS

| | | | | |
|---|---|---|---|---|
| 3,727,232 | * | 4/1973 | Grant | 343/815 |
| 3,984,841 | * | 10/1976 | Mikulich et al. | 343/792.5 |
| 4,145,694 | * | 3/1979 | Sletten | 343/727 |
| 4,609,866 | * | 9/1986 | Loftness | 343/878 |

* cited by examiner

*Primary Examiner*—Tho Phan

(57) ABSTRACT

A combined VHF/UHF active antenna, suitable for indoor use, includes a common element that serves as a reflector for UHF signals and as a director for VHF signals. The VHF element is bent upon itself to permit its packaging as a consumer product accessory.

4 Claims, 2 Drawing Sheets

COMBINED UHF AND VHF ANTENNA

CROSS REFERENCE TO RELATED APPLICATION

This invention is related to commonly assigned application serial No. 09/469,420, filed Dec. 23, 1999, entitled Dipole UHF Antenna in the name of the inventor.

BACKGROUND OF THE INVENTION

This invention relates generally to VHF/UHF antennas and particularly to VHF/UHF antennas that are intended for indoor use. With the recent adoption of television signal transmission standards for HDTV (High definition television) signals and ATSC (Advanced television systems committee) type signals, the need for significantly improved VHF/UHF antennas, primarily for indoor use, has become apparent. The most popular form of prior art VHF antenna was the ubiquitous "rabbit ears", which took up a great deal of space when fully extended and was difficult to adjust properly. Similarly, the "bow tie" UHF antenna was sensitive to adjustment and left a great deal to be desired in terms of performance. What is needed is an indoor antenna to replace both the rabbit ears and bow tie of the prior art and, hopefully do so with improved reception characteristics, since the transmitted signals are digital, which makes it imperative that signal reception be optimized to prevent data corruption.

Conventional VHF/UHF indoor antennas are limited in gain and directivity, and in some instances, very sensitive to the direction of the received signals. In an analog multipath environment, signal reflections and reduced gains are more tolerable in that, while the quality of the picture may be compromised, the viewer is presented with a viewable, though less than ideal, picture. With digital signals, these same signal impairments most often result in no viewable picture. Further, these transmitted digital signals require a lower voltage standing wave ratio (VSWR), between the antenna and receiver RF input terminals, than their analog counterparts and it is also very important to maintain a high signal to noise ratio.

Another draw back of the prior art rabbit ears and bow tie antennas was esthetic. The indoor antenna ideally should not be visible, or at least not look like the prior art devices. The combined antenna of the invention arranges the various elements such that the antenna may be conveniently packaged, in an unobtrusive way, with the television receiver. This is especially important due to the new, higher, aspect ratio of the picture tubes that are specially designed for HDTV receivers.

The combined Low VHF, High VHF and UHF antenna of the invention uses a UHF antenna as disclosed and claimed in the above-mentioned copending application in combination with a Low and High VHF antenna, in which the reflecting backplate of the UHF antenna also serves as a directing element for the VHF antennas. As fully discussed in the copending application, the increased width/length ratio of the UHF antenna improves its wideband performance, whereas the reflector guarantees a 10 to 15 dB front to back ratio in addition to providing excellent decoupling between the UHF output and the dipole elements. While the copending application also discloses and claims different configurations of active versions of the UHF antenna only a single version of the antenna is disclosed in the combination VHF/UHF antenna of the present invention. The inventive antenna also includes a "folded" dipole VHF element for enabling compact packaging of the antenna, without undue performance deterioration. The folded arrangement, for example, adapts itself for integration with HDTV television receivers that incorporate picture tubes of the new, higher, aspect ratio.

OBJECTS OF THE INVENTION

A principal object of the invention is to provide a novel combination VHF/UHF antenna.

Another object of the invention is to provide an improved indoor VHF/UHF antenna.

A further object of the invention is to provide conveniently packaged indoor VHF/UHF antenna.

BRIEF DESCRIPTION OF THE DRAWINGS

These and other objects and advantages of the invention will be apparent upon reading the following description in conjunction with the drawings in which.

DETAILED DESCRIPTION OF THE INVENTION

Figure 1:
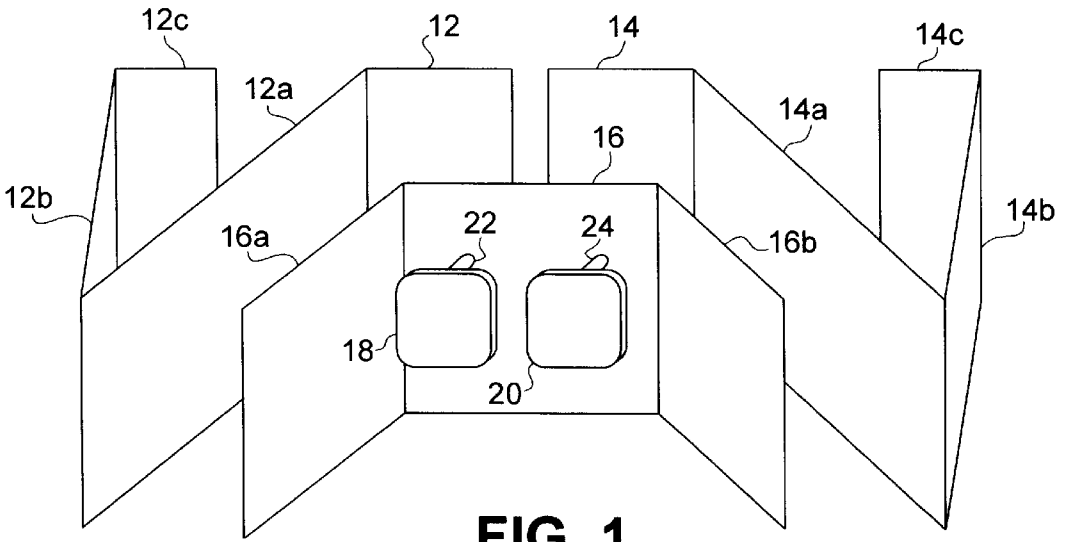
FIG. 1 is a front perspective view of the antenna of the invention.
Figure 2:
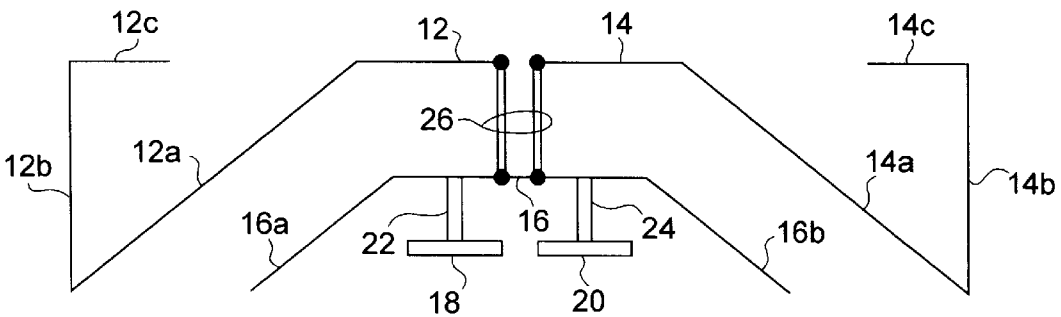
FIG. 2 is a plan view of the antenna of the invention.

Referring to FIGS. 1 and 2, the combined VHF/UHF antenna of the invention includes a VHF dipole comprising elements 12 and 14, an intermediate element 16 and a UHF dipole comprising elements 18 and 20. The intermediate element 16 and the UHF dipole elements 18 and 20 and the conductive supports 22 and 24 therefor are fully disclosed and claimed in the above-mentioned copending application and will not be discussed in detail. In the UHF dipole arrangement, intermediate element 16 serves as a reflector for UHF signals. In this invention, intermediate element 16 also serves as a director for VHF signals and thus performs a double function. The VHF dipole is folded or bent upon itself to reduce its overall "footprint" which enhances its ability to be integrated into various designs for use with television receivers that incorporate the new, higher aspect ratio picture tubes. Specifically, left hand element 12 is bent to form a generally V-shaped section comprising elements 12*a,* 12*b* and 12*c*. Similarly, right hand element 14 is bent to form a generally V-shaped section comprising elements 14*a,* 14*b* and 14*c*. Elements 12*a* and 14*a* are angled to be parallel with the corresponding portions 16*a* and 16*b,* respectively, of intermediate element 16.

Figure 3:
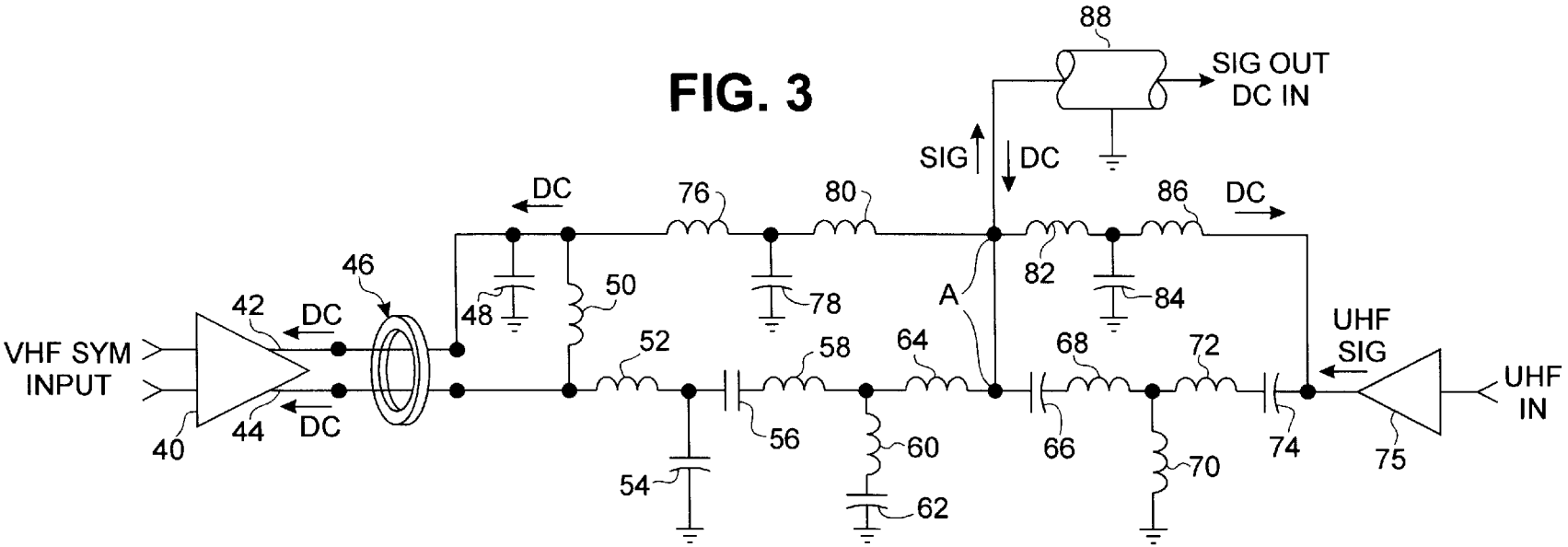
FIG. 3 is a schematic diagram of the amplifier and diplexer portions of the antenna of the invention.

FIG. 3 illustrates the electronic parts arrangement for the combined antenna of the invention. A symmetrical VHF push-pull amplifier 40 receives both Low VHF and High VHF band signals at its input from VHF antenna elements 12 and 14 by means of a stripline 26 and has its output leads 42 and 44 coupled to a ferrite core balun 46. Output leads 42 and 44 couple DC power to push-pull amplifier 40 and also convey signals from the amplifier. The "hot" output lead from balun 46 supplies an inductor 52, which is connected to the junction of a capacitor 54, that is connected to ground, and a series connection of a capacitor 56 and an inductor 58. Inductor 58 is connected to ground through a notch circuit comprising an inductor 60 and a capacitor 62. Inductor 58 is also connected to a junction A through an inductor 64.

On the UHF side, an amplifier 75 supplies signal to a capacitor 74 that is connected to an inductor 72, which is returned to ground through an inductor 70. Inductor 72 is also connected to an inductor 68 that is connected through a capacitor 66 to junction A. Junction A is the input for DC power and the output for the antenna signal, which is coupled to a coaxial cable 88.

DC power is supplied to amplifiers 40 and 75 from junction A as follows: For push-pull amplifier 40, the path is through a choke 80, (with the RF bypassed to ground through a capacitor 78) through a choke 76, (again with the RF bypassed to ground through a capacitor 48) to the "cold" end of balun 46, while the hot end of balun 46 is supplied with DC power through a choke 50. For amplifier 75, the path is through a choke 82, (that is RF bypassed to ground through a capacitor 84), through a choke 86 to the output of amplifier 75. It will be appreciated that the UHF amplifier may be formed directly on the surfaces of the UHF antenna dipole elements as described in the copending application while the VHF amplifier may be carried by director/reflector element 16. Similarly, the inductances and capacitance may be implemented on the printed circuit board materials of the antenna element 16.

Figure 4:
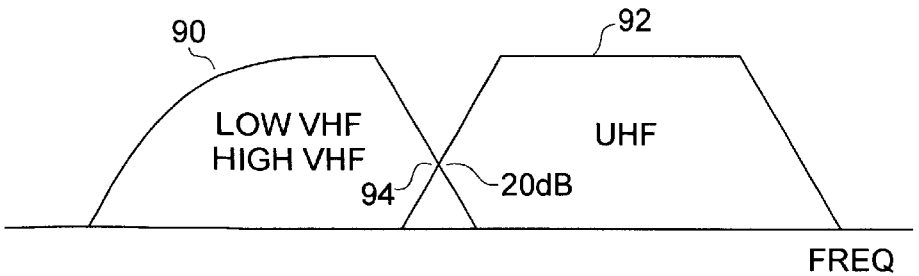
FIG. 4 illustrates the frequency response of the antenna of the invention.

The combined VHF/UHF antenna of the invention has a "folded" dipole VHF element having a width that is preferably around sixty centimeters. While the bending of the element upon itself somewhat increases the VSWR of the VHF antenna, the reduced footprint gives it greater mechanical design flexibility. Further, the directivity supplied by the intermediate element increases the gain of the VHF elements at 175 to 215 MHz (high VHF) by a few dB. The front to back ratio for the Low VHF spectrum is 0 dB. The front to back ratio for the High VHF spectrum is 3 to 4 dB, whereas the front to back ratio for UHF is 10 to 15 dB FIG. 4 indicates the general spectrum response of the combination antenna of the invention over the VHF/UHF frequency range. The Low VHF and High VHF response is indicated by reference 90 and the UHF response is indicated by reference 92. The crossover point 94 of the two response curves is approximately 20 dB down from the maximum response.

Figure 5:
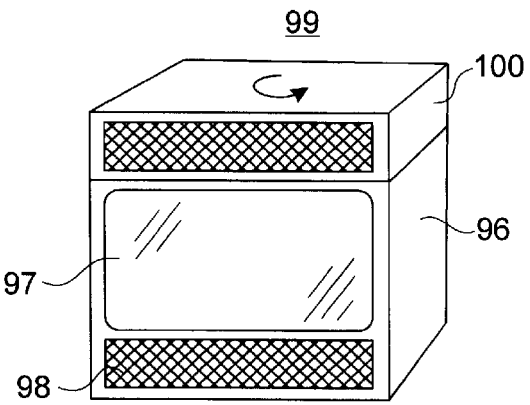
FIG. 5 illustrates a possible packaging arrangement for the antenna of the invention with a HDTV television receiver.

In FIG. 5, a cabinet structure 99 includes a television receiver 96, having a picture tube 97 of the new, higher, aspect ratio, and a speaker system 98 in the lower portion of television receiver 96. An upper portion 100 of the cabinet 99 conveniently houses a combination VHF/UHF antenna that is constructed in accordance with the invention. Since, in all probability, the orientation of the antenna will need to be changed for best reception among different signals, it may be rotatably mounted in portion 100, or portion 100 itself may be rotatably mounted, detachable or positioned on television receiver 96. It will be appreciated that other structures may be used to house the antenna, the illustration merely represents a possible form of housing.

What has been described is a novel combination indoor VHF/UHF antenna that includes a common element that functions as a reflector for UHF signals and as a director for upper end VHF signals. It is recognized that numerous changes to the described embodiment of the invention will be apparent to those skilled in the art without departing from its true spirit and scope. The invention is to be limited only as defined in the claims.

I claim:

1. A combined VHF and UHF antenna comprising:

a VHF element, said VHF element being a dipole having a length of approximately 600 millimeters and a height and depth of approximately 200 millimeters;

a UHF element;

an intermediate element positioned between said VHF and UHF elements;

said intermediate element functioning as a director for VHF signals and as a reflector for UHF signals said VHF element, said UHF element and said intermediate element each having planar portions that are disposed in spaced parallel planes with respect to each other; and said VHF element and said intermediate element each including angled portions that are disposed in spaced parallel planes with respect to each other.

2. The antenna of claim 1, wherein said VHF element is bent upon itself to provide a smaller dimension for packaging purposes.

3. The antenna of claim 1, where the approximate average front to back ratios for low VHF signals is 0 dB, for high VHF signals is 3–4 dB and for UHF signals is 10–15 dB.

4. A combined VHF and UHF antenna comprising:

a bent upon itself dipole VHF element having a length of approximately 600 millimeters and a height and depth of approximately 200 millimeters;

a UHF element;

an intermediate element positioned between said VHF and UHF elements; said intermediate element functioning as a director for VHF signals and as a reflector for UHF signals;

said VHF element, said UHF element and said intermediate element each have planar portions that are disposed in spaced parallel planes with respect to each other;

said VHF element and said intermediate element each include angled portions that are disposed in spaced parallel planes with respect to each other; and the approximate average front to back ratios for low VHF signals is 0 dB, for high VHF signals is 1–4 dB and for UHF signals is 10–15 dB.

* * * * *